US007152453B2

(12) United States Patent
Johnson et al.

(10) Patent No.: US 7,152,453 B2
(45) Date of Patent: Dec. 26, 2006

(54) PRESS BRAKE TOOL AND TOOL HOLDER

(75) Inventors: Paul T. Johnson, Stillwater, MN (US); Bryan L. Rogers, Forest Lake, MN (US)

(73) Assignee: Wilson Tool International, Inc., White Bear Lake, MN (US)

( * ) Notice: Subject to any disclaimer, the term of this patent is extended or adjusted under 35 U.S.C. 154(b) by 0 days.

(21) Appl. No.: 11/020,663

(22) Filed: Dec. 22, 2004

(65) Prior Publication Data

US 2005/0178183 A1 Aug. 18, 2005

Related U.S. Application Data

(63) Continuation-in-part of application No. 10/778,296, filed on Feb. 13, 2004, now Pat. No. 6,848,291.

(51) Int. Cl.
*B21D 37/04* (2006.01)
*B21D 37/14* (2006.01)

(52) U.S. Cl. ..... 72/481.1; 72/482.92; 72/389.4; 72/481.2

(58) Field of Classification Search ..... 72/481.1, 72/481.2, 481.3, 481.6, 481.9, 482.2, 482.91, 72/482.92, 389.4, 482.93, 482.1
See application file for complete search history.

(56) References Cited

U.S. PATENT DOCUMENTS

| | | | |
|---|---|---|---|
| 2,755,758 | A | 7/1956 | Johansen |
| 4,268,323 | A | 5/1981 | Jakubowski et al. |
| 4,790,888 | A | 12/1988 | Bessey |
| 4,993,255 | A | 2/1991 | Treillet |
| 5,234,721 | A | 8/1993 | Rostoker et al. |
| 5,245,854 | A | 9/1993 | Bruggink et al. |
| 5,460,027 | A | 10/1995 | Takahashi |
| 5,511,407 | A | 4/1996 | Kawano |
| 5,513,514 | A | 5/1996 | Kawano |
| 5,572,902 | A | 11/1996 | Kawano |
| 5,619,885 | A | 4/1997 | Kawano et al. |
| 5,642,642 | A | 7/1997 | Kawano |
| 5,782,308 | A | 7/1998 | Latten et al. |

(Continued)

FOREIGN PATENT DOCUMENTS

| | | |
|---|---|---|
| EP | 237800 | 9/1987 |

(Continued)

OTHER PUBLICATIONS

ASM International Handbook Committee, Revised vol. 4: Heat Treating, pp. 410-424 (1994).

*Primary Examiner*—David B. Jones
(74) *Attorney, Agent, or Firm*—Fredrikson & Byron, P.A.

(57) ABSTRACT

A press brake tool and tool holder. The tool has a body terminating downwardly in a workpiece-engaging surface and a tang extending upwardly from the body and adapted for reception in a tool holder, the tang having a first wall defining a vertical surface and a second wall on the opposite side of the tang having a recess formed therein having a contact surface. The tool holder has an opening therein for reception of the tool tang, a vertical surface engagable with the vertical surface of the tang, and a clamping pin movable transversely of the opening for clamping the tool in the holder. The pin has a camming surface configured to engage the contact surface of the tang in line contact to exert a force on the tang having vertical and horizontal components, the ratio of the vertical component to the horizontal component desirably changing as the clamping pin clamps against the contact surface of the tang.

41 Claims, 6 Drawing Sheets

U.S. PATENT DOCUMENTS

| | | | | |
|---|---|---|---|---|
| 6,003,360 | A | 12/1999 | Runk et al. | |
| 6,138,492 | A | 10/2000 | Vining et al. | |
| 6,151,951 | A | 11/2000 | Kawano | |
| 6,467,327 | B1 | 10/2002 | Runk et al. | |
| 6,494,075 | B1 | 12/2002 | Pelech, Jr. | |
| 6,557,390 | B1 | 5/2003 | Runk et al. | |
| 6,564,611 | B1 | 5/2003 | Harrington et al. | |
| 6,843,760 | B1 * | 1/2005 | Akami et al. | 72/481.6 |
| 6,848,291 | B1 * | 2/2005 | Johnson et al. | 72/482.2 |
| 6,928,852 | B1 * | 8/2005 | Enderink | 72/481.1 |

FOREIGN PATENT DOCUMENTS

| | | |
|---|---|---|
| FR | 2691652 | 12/1993 |
| JP | 62-267019 | 11/1987 |
| WO | WO 00/59655 | 10/2000 |

* cited by examiner

PRESS BRAKE TOOL AND TOOL HOLDER

CROSS-REFERENCE TO RELATED APPLICATIONS

This application is a continuation-in-part of Johnson et al. U.S. patent application Ser. No. 10/778,296, filed Feb. 13, 2004 now U.S. Pat. No. 6,848,291 and entitled Press Brake Tool and Tool Holder, the disclosure of which is incorporated herein by reference in its entirety.

FIELD OF THE INVENTION

This invention relates to press brake technology, and particularly to tools and tool holders used in various press brakes.

BACKGROUND OF THE INVENTION

Press brakes are employed to bend metal sheets into desired configurations. A press brake commonly is equipped with a lower table and an upper table, one or both of which are moveable to close the tables upon a workpiece positioned between the tables. Forming tools are mounted-to the tables so that when the tables are brought together, a work piece between the forming tables is bent into an appropriate shape. The upper table commonly includes a male forming tool having a lower work piece-deforming portion of a desired shape, such as a right angled bend, and the lower table commonly has an appropriately shaped and aligned die, which for example may be V-shaped and open upwardly to receive the work piece-deforming portion of the upper tool. A metal sheet positioned between the tool and die thus is pressed into a desired shape. Forming tools and dies commonly are horizontally elongated so that work pieces of various widths can be accommodated.

It is often necessary to exchange forming tools and dies to accommodate different bending operations. The dies, commonly resting on the lower table of a press brake, are readily removed and exchanged for others. The forming tools that are mounted to the upper table of a press brake often are not so easily replaced, however. Tool holders that are carried by the upper table commonly make use of a clamp that clamps upon an upwardly extending tang of a forming tool to hold the tool in the holder.

Tool holders and tools may have respective interlocking safety keys and key-receiving grooves to restrain accidental dropping of tools once the clamp of the holder has been loosened. Forming tools can in some instances be removed downwardly from the holder once the clamp is loosened, and in other instances the forming tool must be removed by horizontally sliding it from the holder. If a forming tool of some length (and hence of some substantial weight) is to be replaced, it sometimes is difficult to slide the forming tool horizontally from its holder because of the proximity of neighboring forming tools which may themselves have to be removed in order to complete the tool exchange process. Because long forming tools can be quite heavy, when a clamp is loosened to the point that the tool can be removed by moving it downwardly, care must be taken to prevent the tool from slipping from the tool holder and falling.

Various press brake tool holders have been devised in an effort to facilitate the exchange of one forming tool for another. Examples of the tool holders of this type are shown in U.S. Pat. Nos. 5,513,514, 5,511,407 and 5,572,902. More recent tool holders are described in U.S. Pat. Nos. 6,003,360, 5,245,854, and 6,467,327.

U.S. Pat. No. 5,619,885, the disclosures of which are incorporated herein by reference, shows a press brake tool and tool holder in which the tang of the tool is provided with a vertical sliding surface that slides against a vertical surface of a plate of the holder. The reverse side of the tang is provided with a slanted planar surface that diverges downwardly from the vertical surface. The holder and tool also have engagable, generally horizontal, force-transmitting surfaces for transmitting vertical forces between the upper table and the tool. The slanted surface of the tang is designed to come into surface-to-surface contact with a clamp element of the tool holder when the tool is pushed upwardly into the holder. Because of this slanted configuration of the tang, the clamp of the tool holder is forced open when the tool is forced upwardly between the plate and clamp. As the tool is pushed upwardly, a lip on the clamp engages a safety-groove formed in the tool. The force exerted by the clamp upon the tang has a horizontal component to clamp the tang against the vertical surface of the holder plate, but this force also has a downwardly directed component. Clamps and tools of this type generally are known as "Amada style", and are commonly sold under the trademark "One Touch". U.S. Pat. No. 6,003,360, assigned to the assignee of the present application, shows a tool holder manufactured by Wilson Tool International, Inc. and sold under the registered trademark "Express®". Note should be made that the tangs of the press brake tools described in this patent are exemplified as being generally rectangular in cross-section, as compared to the generally wedge-shaped or slanted tangs of the Amada-type tools shown in U.S. Pat. No. 5,619,885.

Other Press brake tools and tool holders are shown in U.S. Pat. Nos. 6,138,492 and 6,557,390, both of which are assigned to the assignee of the present invention. See also U.S. Pat. No. 6,564,611. A summary of certain types of press brake tools and tool holders is provided in U.S. Pat. No. 6,467,327, the contents of which are incorporated herein in its entirety by reference and which describes "American" style tool holders and tools.

SUMMARY OF THE INVENTION

A press brake tool and tool holder are provided. In one embodiment, the tool has a body terminating downwardly in a workpiece-engaging surface and a tang extending upwardly from the body and adapted for reception in a tool holder, the tang having a first wall defining a vertical surface and a second wall on the opposite side of the tang having a recess formed therein having a contact surface. The tool holder has an opening therein for reception of the tool tang, a vertical surface engagable with the vertical surface of the tang, and a clamping pin movable transversely of the opening for clamping the tool in the holder. The pin has a camming surface configured to engage the contact surface of the tang. The contact surface and the camming surface are so configured as to exert a force on the tang having vertical and horizontal components, the ratio of the vertical component to the horizontal component changing as the clamping pin clamps against the contact surface of the tang.

In a further embodiment, a press brake tool and tool holder are provided, the tool having a body terminating downwardly in a workpiece-engaging surface and a tang extending upwardly from the body and adapted for reception in a tool holder, the tang having a first wall defining a vertical surface and a second wall on the opposite side of the tang having an elongated recess formed therein that has a contact surface. The tool holder has an opening therein for reception of the tool tang, a vertical surface engagable with the vertical surface of the tang, and a clamping pin movable transversely of the opening and having a camming end configured to contact the contact surface of the tang. The contact surface, the camming surface or both are so configured as to engage each other in line contact and to exert a clamping-force on the tang having vertical and horizontal components to raise said tang within the holder and clamp the vertical surfaces together, respectively.

In another embodiment, a press brake tool and tool holder are provided, the tool having a body that terminates downwardly in a work piece engaging surface and that includes a tang extending upwardly from the body for reception in a tool holder. The tang has a first wall defining a vertical surface for engagement with a cooperating vertical surface of the tool holder, and the tang has a second wall on the reverse side of the tang that defines an arcuate, concave surface. The concave surface includes an upper contact surface that is tangent to a plane that is downwardly convergent with respect to the vertical surface such that a force delivered to that contact surface includes an upward component tending to lift the tang into the tool holder. Preferably, the arcuate surface is formed on a plurality of radii formed on spaced horizontal axes and including an upper radius and a lower radius, the upper radius being smaller than the lower radius.

In yet another embodiment, a tool and tool holder are provided, the tool having a body terminating downwardly in a workpiece-engaging surface and a tang extending upwardly from the body and adapted for reception in a tool holder. The tang has a first wall defining a vertical surface and a second wall on the opposite side of the tang having an elongated recess formed therein, the recess having a contact surface with a surface hardness in the range of about 60 to about 70 Rockwell C. The tool holder has an opening therein for reception of the tool tang, a vertical surface engagable with the vertical surface of the tang, and a clamping pin movable transversely of the opening and having a camming surface with a surface hardness in the range of about 45 to about 57 Rockwell C. The camming surface is configured to contact the contact surface of the tang, and the contact surface, the camming surface or both being so configured as to engage each other and to exert a clamping force on the tang having vertical and horizontal components to raise the tang within the holder and clamp the vertical surfaces together, respectively.

DETAILED DESCRIPTION

Figure 1:
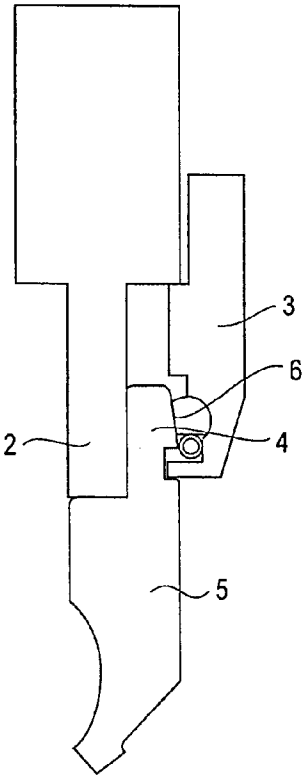
FIG. 1 (PRIOR ART)
FIG. 1 is a schematic end-view of a prior art Amada-style press-brake tool and tool holder.

As background, FIG. 1 shows an Amada-style tool and tool holder, the tool holder having a vertical mounting plate 2 and a clamp 3. The tang 4 of a press brake tool 5 has a slanted surface 6 so configured that when the tool is forced upwardly between the plate and the clamp, the clamp is cammed open by the slanted surface 6. The holder is generally of the type shown in U.S. Pat. No. 5,619,885, assigned on its face to Amada Metrecs Company, Ltd.

Figure 2:
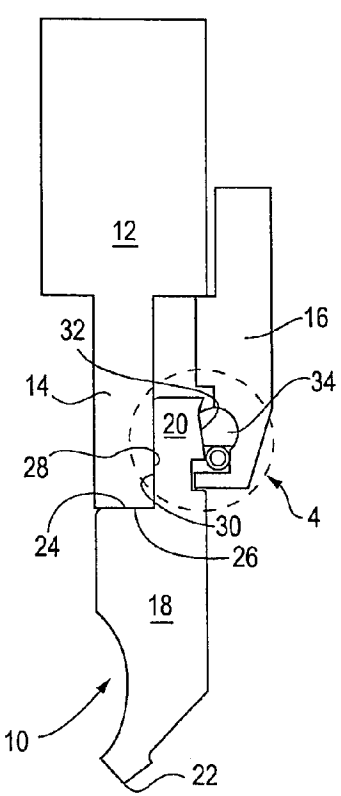
FIG. 2 is a schematic end-view of a press-brake tool of the invention together with an Amada-style tool holder.

Referring now to FIG. 2, a similar press brake tool holder is shown having a body 12, a downwardly extending plate 14 and a clamp 16. It will be understood that in certain of these schematic views of well known press brake tool holders, the structure holding the clamp 16 to the remainder of the holder has been omitted. It should be understood that the omitted structure is such that the clamp 16 generally pivots about its connection to the holder 12 such that the lower portion of the clamp is moved generally horizontally toward and away from the support plate 14. In the current commercial embodiment of the tool holder shown in FIG. 2, the tool holder includes a lever which is movable by the operator to pivot the clamp toward and away from the plate 14.

Figure 3:
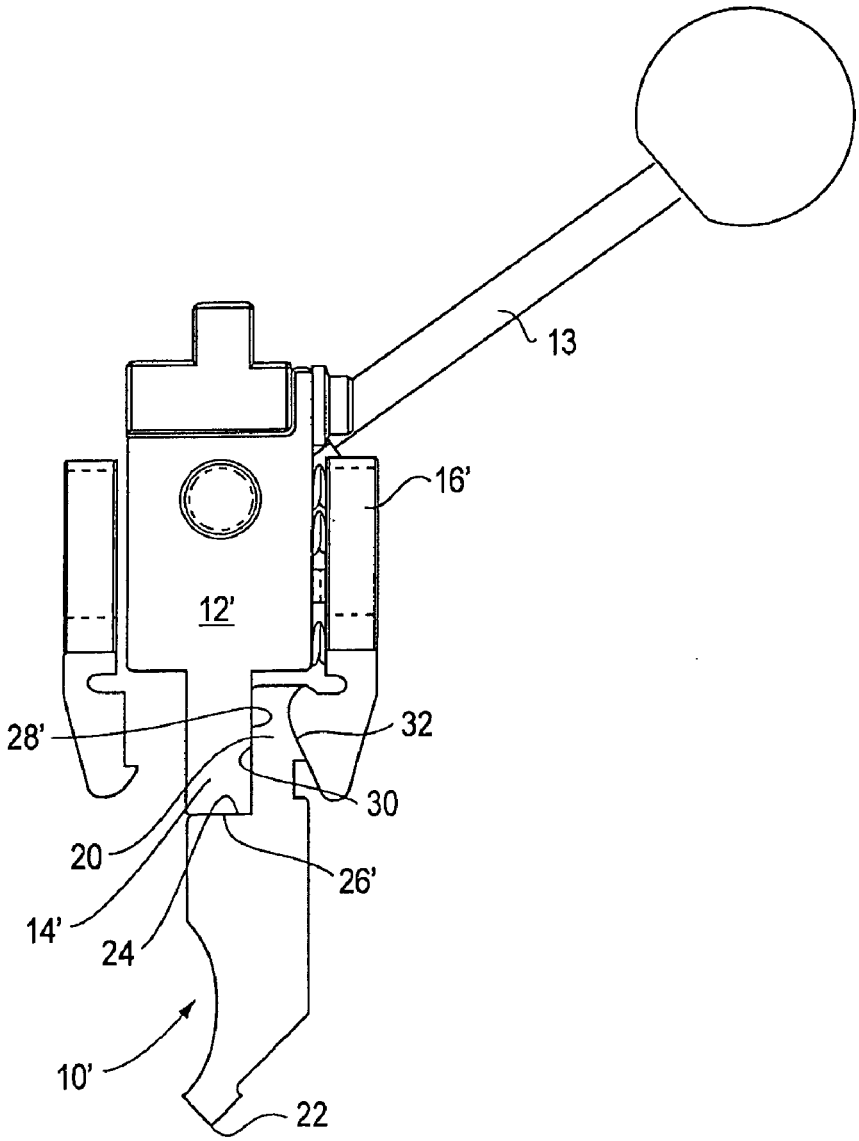
FIG. 3 is a schematic end-view of another embodiment of a press-brake tool of the invention as received within a Wilson-style tool holder.

In FIG. 3, the holder, which is of the Wilson type, includes a body 12' that includes a support plate 14' and a clamp 16', the clamp being pivotally attached to the body 12. A lever 13, movable parallel to the plane of the paper, can be operated by the operator to move the lower end of the clamp toward and away from the plate 14.

FIGS. 2 and 3 depict press brake tools that are substantially different from the slanted tool shown in FIG. 1. Each tool has a body portion 18, an upwardly extending tang 20 adapted to be received between the support plate and the clamp of a press brake tool holder, and a lower, work engaging surface 22. The tools themselves include generally horizontal, upwardly facing shoulders 24 that engage complementary downwardly facing surfaces 26 of the tool holder's support plate 14, 14', the surfaces serving to transmit force downwardly from the upper table (not shown) to the press brake tools 10, 10' of FIGS. 2 and 3. Moreover, the tool holder support plates 14, 14', respectively of the embodiments of FIGS. 2 and 3 each have vertical surfaces 28, 28' that engage vertical surfaces 30 of the tangs 20. As shown in FIGS. 2 and 3, as the tools 10, 10' are moved upwardly, the surfaces 28, 30 (FIG. 2) and 28', 30 (FIG. 3) come into surface to surface contact. As each tool moves upwardly, its shoulder 24 comes into contact with and is locked against the bottom surface 26, 26' of the support plate.

Figure 4:
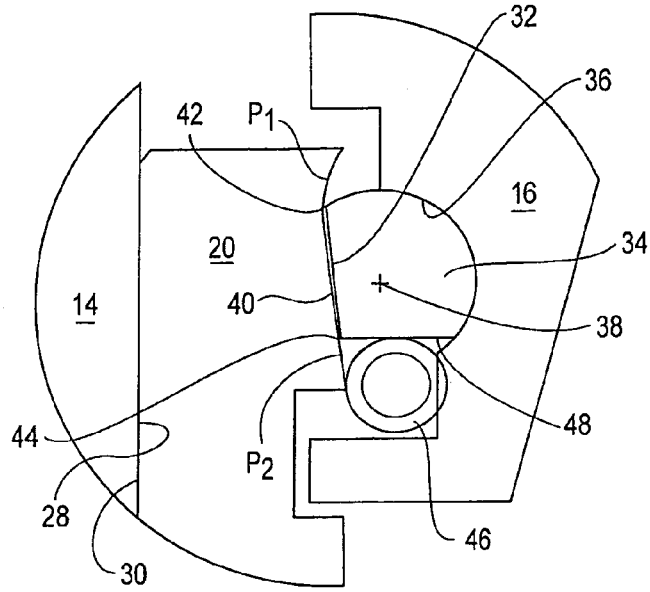
FIG. 4 is an enlarged view of the circled portion of FIG. 2.
Figure 5:
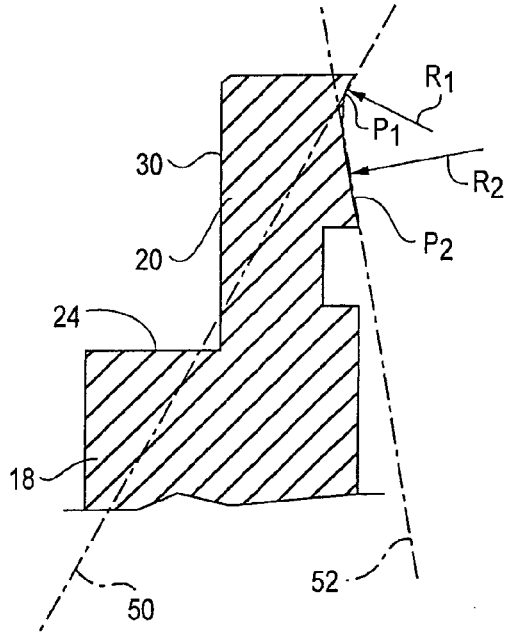
FIG. 5 is a broken away cross-section of a portion of a press-brake tool of the invention.

In the embodiment shown in FIGS. 2 through 5, the reverse surface 32 of the tang has an arcuate, concave shape, and is described best with reference to FIGS. 4 and 5, to which we now turn.

Referring to FIG. 5, the tang portion 20 of a tool of the invention is shown in cross section. Its arcuate surface 32, the reverse of the surface 30, is formed desirably on a plurality of radii about spaced horizontal axes. In FIG. 5, the upper portion of the arcuate surface—that indicated at point $P_1$—is formed on a radius $R_1$, whereas the lower portion of the arcuate surface indicated at $P_2$ is formed about a larger radius $R_2$. That is, the radius upon which different portions of the arcuate surface 32 is formed is smallest near the top of that surface and largest at the bottom of that surface, in a desired embodiment.

Referring to FIG. 4, which is an enlargement of the circled portion 4 in FIG. 2, the tool holder clamp 16 includes a horizontally extending rod 34 that is received within a generally circular groove 36 of the clamp and hence can rotate within the clamp about an axis 38. A portion of the surface of the rod is planar, as shown at 40, that planar surface intersecting the generally cylindrical outer surface of the rod at edges 42, 44. As the clamp is forced against the surface 32 of the tang, its edges 42, 44 come into contact with the arcuate surface of the tang at $P_1$, $P_2$, respectively. Slight rotation of the rod 34 distributes the load between the edges 42, 44. A horizontally extending helical spring 46 supports the rod 34 and bears upwardly against a second flat surface 48 of the rod.

Referring again to FIG. 5, $P_1$ represents the upper contact surface of the arcuate surface 32 that is contacted by the point 42 of the rod 34 as the clamp engages the arcuate surface of the tang. Similarly, $P_2$ represents the lower contact surface that is engaged by the point 44 of the rod. It will be understood that the edges 42, 44 of the rod are shown as points in the side view of FIG. 4, these points actually represent lines that are the intersection of the planar surface 40 and the generally cylindrical surface of the rod, and that $P_1$ and $P_2$ represent lines on the arcuate surface of the tang that are contacted by the respective intersections 42, 44.

Referring to FIG. 5, one may draw a plane 50 that is tangent to the arcuate surface of the tang at $P_1$, and another plane 52 that is tangent to the arcuate surface at point $P_2$. Whereas plane 50 is convergent downwardly with respect to the vertical surface 30 of the tang, the plane 52 is convergent upwardly with that surface. From the standpoint of force vectors, a force delivered by the edge 42 of the rod 34 at point $P_1$ will act normal to the tangent 50, and the force thus will have a horizontal component and a vertical component. The vertical component urges the tang upwardly when the tang is clamped in the tool holder. Similarly, the force exerted by the clamp at point $P_2$ will act normal to the plane 52, and that force will have horizontal and vertically downward components. Inasmuch as the angle between the vertical surface 30 and plane 50 is greater in absolute value than the angle between the vertical surface 30 and the plane 52, the upward component of force acting at $P_1$ will be greater than the downward component of force acting at point $P_2$, with the net vertical force then being upward. This assumes that the force delivered at $P_1$ and $P_2$ will be essentially equal, and the latter condition is a result of the slight rotation of the rod 34 as it comes into contact with the arcuate surface of the tang.

FIG. 3 shows another embodiment of a tool and tool holder of the invention. Here, the arcuate surface 32 of the tool holder is formed generally as shown in FIG. 5, but the portion of the clamp 16' that engaged the arcuate surface of the tang is shaped to be at least partially congruent with that arcuate surface, as shown in FIG. 3. As thus illustrated, the curved surface of the clamp that fits congruently against the upper arcuate surface of the tang exerts a net upward force against the upper surface of the tang.

The use of an arcuate surface 32 of the tang against which the clamp presses, as opposed to a flat surface, for example, assures that the force exerted by the clamp will act in a direction normal to the tangent of a plane drawn to that portion of the arcuate surface contacted by the clamp. The distribution of force components against the arcuate tang can be readily varied as desired by changing the degree of curvature of the tang to thus change the angle that the planes 50, 52 make with the vertical. Radius $R_2$ may be several times greater than $R_1$, and will act about a horizontal axis spaced (in FIG. 5) far to the right of that figure and accordingly not shown in FIG. 5. For example, the radius $R_1$ may be on the order of one inch, whereas the radius $R_2$ may be on the order of four inches. The surfaces that are generated by these radii about their axes desirably merge smoothly into one another, and of course other radii may appropriately be employed to sweep out other areas of the arcuate surface, it being desired that the curve of the arcuate surface of the tang be smooth and without abrupt surface changes.

FIGS. 7 through 14 describe further embodiments of the invention, certain of which embodiments employ arcuate, curved surfaces to vary the generally horizontal clamping force component and the vertical force components tending to lift the tang of the press brake tool to appropriately seat it in the tool holder. In certain other embodiments, the contact surface of the tang recess makes line contact with the clamping pin, and in yet other embodiments, the contact surface of the tang recess is rendered particularly hard, and desirably is harder than the camming surface of the clamping pin.

Figure 6:
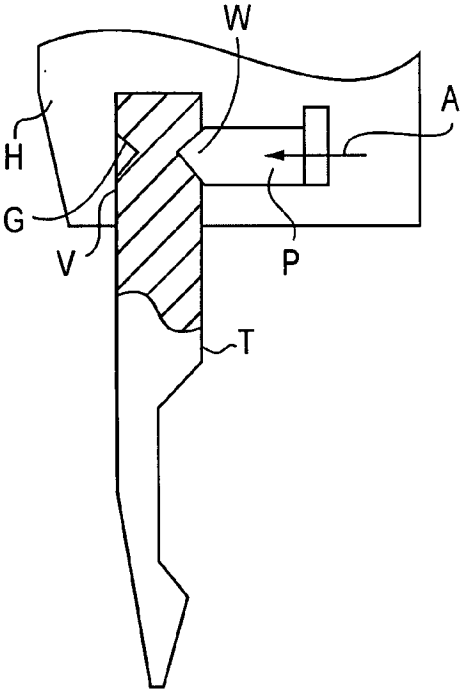
FIG. 6 PRIOR ART
FIG. 6 is a schematic cross section of a tool and tool holder of the type shown in U.S. Pat. No. 5,245,854.

Referring to FIG. 6, this figure shows generally a tool and tool holder of the type described in U.S. Pat. No. 5,245,854 (Bruggink). This prior art tool and tool holder employs a tool having a tang provided with elongated, V-shaped grooves shown at G. A clamping pin has a wedge-shaped end W which is received in the groove to clamp the tool in the tool holder. Force applied in the direction of the arrow A presses the vertical wall V of the tang against the confronting vertical surface of the tool holder, and the similarly shaped and cooperating surfaces of the pin and groove further serve to restrain the tool from slipping downwardly from the tool holder.

Figure 7:
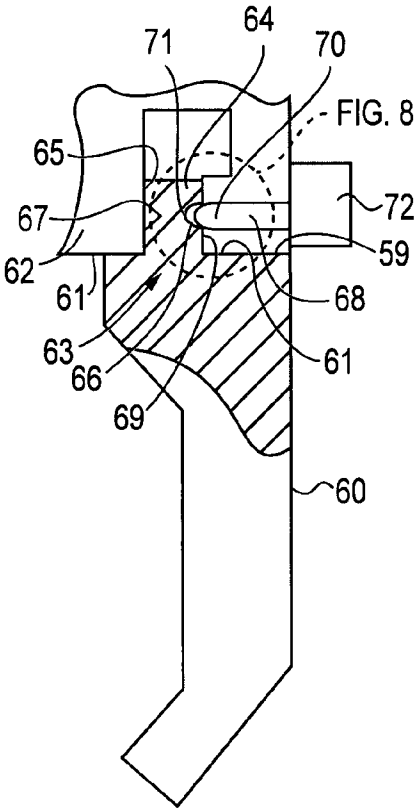
FIG. 7 is a schematic cross section of an embodiment of a tool and tool holder of the invention.

FIG. 7 is a view of one embodiment of a tool 60 and tool holder 62 of the invention. The tool 60 includes an upwardly projecting tang 64 having a generally vertical surface 69 with a laterally extending recess 71 formed in it, the recess having a contact surface designated 66. The tool holder includes a clamping pin 68 that is moveable laterally, that is, generally horizontally, into and out of the groove to make contact with the contact surface 66, the pin terminating forwardly in a camming surface 70. The pin is driven toward the tang of the tool by any appropriate mode of force, and FIG. 7 schematically shows a hydraulic cylinder 72 which, when energized, may drive the pin 68 to the left in FIG. 7. Other electrical or mechanical motive forces may be employed, such as a camming mechanism as typified in U.S. Pat. No. 6,557,390, the teachings of which are incorporated herein by reference. If desired, the motive force may be employed so that application of such force, hydraulic pressure in one example, releases the pin 68 from contact with the contact surface, the pin being maintained, in the absence of hydraulic pressure, firmly to the left, as by use of spring force (not shown).

Figure 8:
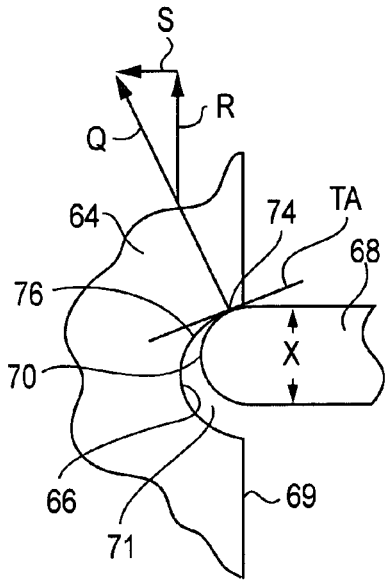
FIG. 8 is a schematic cross section of the encircled portion 8 of the tool and tool holder of FIG. 7.

The clamping mechanism of the tool and tool holder of FIG. 7 can be perhaps better understood by reference to FIG. 8. In this figure, and the figures that follow, the press brake tool 60 is being mounted in a tool holder 62 (FIG. 7), and the clamping pin 68 is being forced to the left to raise the tool vertically into contact with the holder (typified by contact of the tool surface 59 with the confronting surface 61 of the holder) and to clamp the tang 64 firmly against the vertical support surface 65 of the holder. As the pin 68 moves to the left in a clamping movement, the camming surface 70 of the pin engages the contact surface 66 of the groove at point 74. In practice, the pin 68 may have a lateral width resulting in a line contact at 74 between the pin and groove rather than a point contact, the lateral width desirably being somewhat greater than its vertical thickness X. The resulting force that is transmitted by the pin to the tang 64 is directed along vector Q normal to the tangent TA drawn parallel to the engaging, arcuate portions of the camming surface and the contact surface. This resultant force component Q has vertical and horizontal vector components R and S, respectively, the force vector R urging the tang 64 upwardly, and the force vector S urging the tang to the left to clamp against the vertical wall 65 of the holder. Movement of the tang 64 to the left in FIG. 7 presses its vertical surface 67 against the supporting vertical surface 65 of the tool holder to hold the tool in place.

Referring again to FIG. 8, once the pin 68 has moved sufficiently far to the left so that its point or line of contact with the contact surface 66 has moved to the position designated 76, the ratio of R to S will be smaller as the horizontal force vector S increases and the vertical force vector R decreases.

Figure 9:
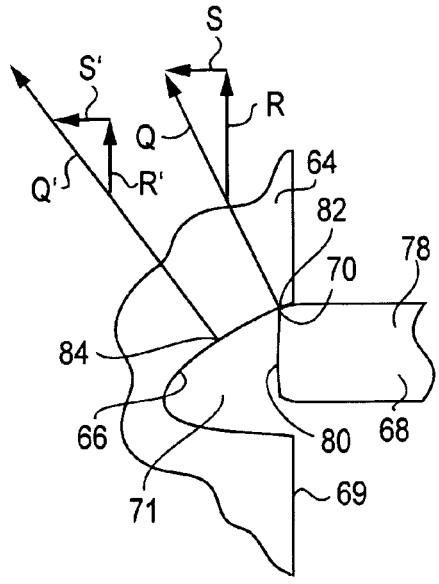
FIG. 9 is a view similar to FIG. 8 but showing another embodiment.

A somewhat different configuration for the contact surface 66 and the camming surface 70 of the pin 68 is shown in FIG. 9. Here, the pin 68 has a generally rectangular end configuration, with the top wall 78 of the pin being at approximately right angles to the end wall 80, these walls intersecting at a camming surface 70. The line of contact between the camming surface 70 of the pin and the contact surface 66 is shown at 82, generating a force in the direction of vector Q having vertical and horizontal force components R and S. At point 82, the vertical force component R is substantially greater than the force component S. As the pin 68 moves more deeply into the groove, the engagement of the camming surface 70 with the contact surface 66 will move to point or line 84, generating a force vector Q' having vertical and horizontal force vectors R' and S'. In this embodiment, the ratio of R' to S' is substantially less than the ratio of R to S—that is, the ratio of the vertical to horizontal force components changes as the pin 68 moves to the left and to the groove. Note that, in FIG. 9, the contact surface 66 is concave toward the camming surface 70 of the pin, and the camming surface 70 is convex toward the contact surface 66.

Figure 10:
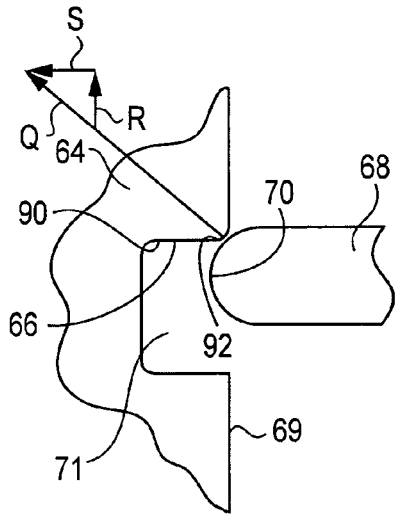
FIG. 10 is a view similar to FIG. 8 but showing yet another embodiment.
Figure 11:
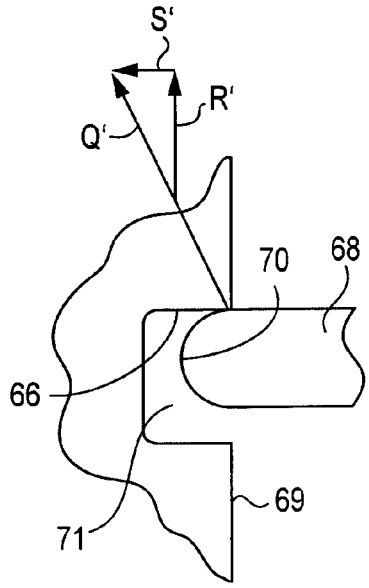
FIG. 11 is a schematic cross section of the tool and tool holder of FIG. 10 showing another step in a tool clamping procedure.

In the embodiment of FIGS. 10 and 11, the camming surface 70 of the pin is somewhat circular in cross-section, whereas the groove is generally rectangular in cross section with the groove having a top wall 90 that intersects the wall of the tang at a rounded edge 92. As shown in FIG. 10, as the pin 68 moves to the left, its camming surface 70 encounters the contact surface of the tang at point 92, generating a force vector Q having vertical and horizontal force components R and S. As the pin moves further to the left, as shown in FIG. 11, the line of contact of the contact surface 66 with the camming surface 70 of the pin has moved upward and to the right of the end of the pin as the tang has moved upwardly, generating a force vector Q' having vertical and horizontal components R' and S'. Here, the ratio of R' to S' is greater than the ratio of R to S in FIG. 10. That is, as the clamping pin 68 proceeds to the left in FIGS. 10 and 11, it initially produces a strong clamping force and a slightly smaller vertical seating force on the tang, with the clamping force being reduced and the seating force being increased as the pin proceeds to the position shown in FIG. 11. Note may be made that this change in the ratios of R to S is opposite that shown in the embodiments of FIG. 8 and FIG. 9; in FIGS. 8 and 9, initial contact of the camming surface of the pin with the contact surface of the tang groove produced a large lifting force vector and a small clamping force vector, but as the pin proceeded into the groove, the clamping force vector increased and the lifting force vector decreased.

Figure 12:
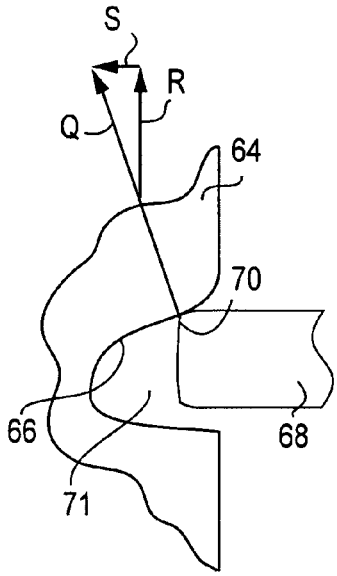
FIG. 12 is a schematic cross section similar to that of FIG. 1 but showing a further embodiment.

It will be understood that a wide variety of camming surface and contact surface configurations may be employed so that the ratio of the vertical to the horizontal force components varies as the pin moves into the groove. In FIG. 12, for example, the pin has a generally rectangular end configuration similar to that shown in FIG. 9, providing a slightly rounded camming surface 70. Whereas the contact surface 66 in FIG. 9 is concave with respect to the camming surface 70, the contact surface 66 in FIG. 12 is convex with respect to the camming surface 70. Thus, in FIG. 12, as the pin moves to the left, the force vector Q becomes more vertical and the ratio of R to S increases. As in FIGS. 10 and 11, the groove is shown to be generally rectangular in cross section, with the intersection between the vertical surface of the tang and the upper wall 90 of the groove being gently rounded. As the camming surface of the pin engages the contact surface of the tang, a force is generated along vector Q having vertical and horizontal components R and S. It will be evident that as the pin proceeds further to the left, the intersection between the contact surface and the camming surface will occur higher on the camming surface where the camming surface is slightly more vertical, this, then, producing a force vector Q (not shown) that would have a reduced ratio of R to S.

Figure 14:
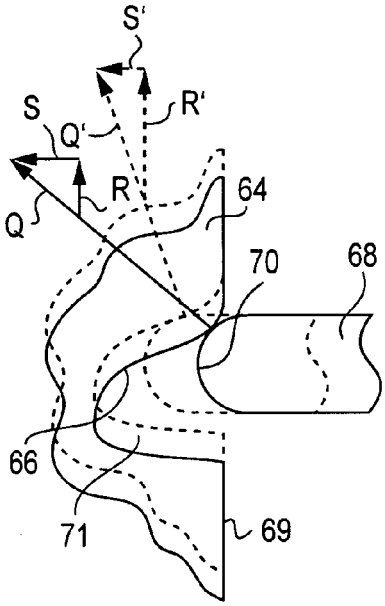
FIG. 14 is a view similar to FIG. 8 but showing yet a further embodiment.

FIG. 14 shows another embodiment in which the pin 68 has a rounded, convex camming surface 70 and the contact surface 66 is convex toward the camming surface. Initial engagement of the camming surface of the pin with the contact surface of the groove produces a resultant force Q having vertical and horizontal components R, S. Continued movement of the pin 68 to the left causes the tang 64 of the tool to move upwardly into the dashed line position as it is simultaneously pressed to the left against the supporting wall 65 of the tool holder (FIG. 7). Pressure of the camming surface 70 of the clamping pin against the contact surface 66 in the dashed line position of this Figure produces a force vector Q' having vertical and horizontal components R' and S', the ratio of R' to S' thus having increased as clamping proceeded.

Figure 13:
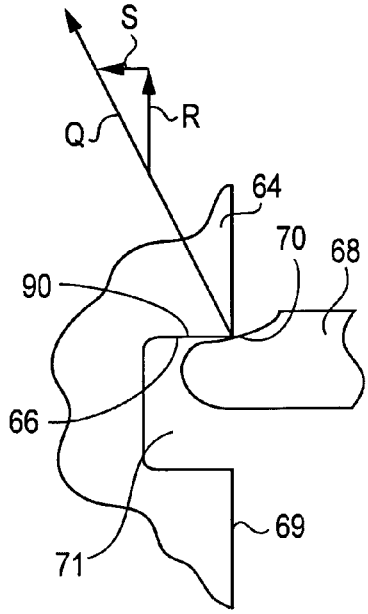
FIG. 13 is a view similar to FIG. 8 but showing another embodiment.

Thus, it will be seen that because of the curved nature of the camming surface of the pin, or the contact surface of the groove or recess of the tang, or both, one may vary the ratio of the vertical force component to the horizontal force component of the resultant force imposed by the clamping pin upon the tang. In the embodiments of FIGS. 9 and 13, the ratio of the vertical force component to the horizontal component decreases as clamping proceeds, that is, as the clamping pin moves to the left. In the embodiment of some of the other figures, the ratio of the vertical force component to the horizontal force component increases as the clamping pin moves into the groove. Moreover, FIG. 13 is an embodiment in which the forward end of the pin is provided with a concave camming surface 70, whereas the camming surface of the pin in previous figures was convex.

Figure 15:
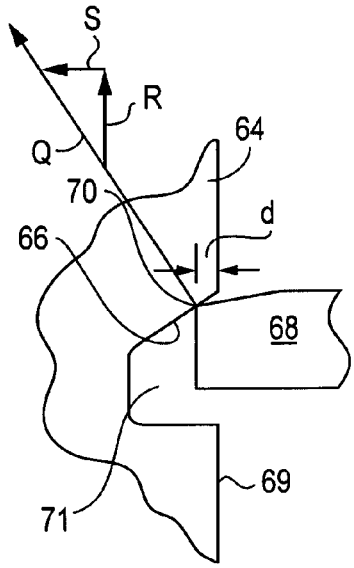
FIG. 15 is a view similar to FIG. 8 but showing yet another embodiment.

In the embodiment of FIG. 15, the tang recess has a generally planar, slanted contact surface 66, while the camming surface of the clamping pin 68 is a rounded edge 70. As the clamping pin is forced to the left in a clamping operation, the camming surface 70 engages the contact surface 66 in line contact and produces a force vector Q that has vertical and horizontal components R and S, respectively. In contrast to other embodiments referred to earlier, the ratio of R to S in this embodiment does not change as clamping proceeds.

As illustrated in the embodiments of FIGS. 7–15, the contact of the camming surface of the pin with the contact surface of the tang recess may be a line contact rather than a surface-to-surface contact, the line of contact running generally parallel to the direction of the recess, e.g., generally horizontal in the drawings. Since a press brake tool may be clamped and unclamped many times as it is inserted into and removed from a tool holder, it is desirable to avoid significant wear of the contact surface of the tang recess to thus promote a long useful life for the tool. To avoid wear, the contact surface of the tang recess may be provided with a substantial hardness, desirably ranging from about 60 to about 70 on the Rockwell C scale. The camming surface of the clamping pin may similarly be made hard, but desirably is softer than the contact surface, e.g., having a Rockwell C hardness in the range of about 45 to about 57. Hardening can be accomplished by various known means, such as by flame hardening, but desirably in accomplished by nitriding or carbonitriding of the contact surface. The latter procedure provides not only a hard surface, but also a particularly slippery surface over which the camming surface of the clamping pin may easily slide. Nitriding and nitrocarburizing processes are known in the field and need not be described with great detail. Reference is made to U.S. Pat. Nos. 4,790,888 and 4,268,323, the latter patent referring to the use of a fused salt bath to enable nitrogen and carbon to diffuse into the surface of a steel piece suspended in the bath, to form a carbonitride case. Reference is made also to U.S. Pat. No. 5,234,721 (referring to methods of forming carbonitride coatings). Nitriding processes, both plasma (ion) nitriding and liquid nitriding, are described in detail in the ASM Handbook prepared under the direction of the ASM International Handbook Committee, Revised vol. 4: *Heat Treating*, pp. 410-424 (1994), the disclosures of which are incorporated by reference herein. Plasma or ion nitriding involves the use of glow discharge technology to provide nascent nitrogen to the surface of a heated steel part. Here, the part is subjected to a nitrogen plasma in a vacuum chamber. Nascent nitrogen diffuses into the surface of the part to form an outer "compound" zone containing $\gamma$ ($Fe_4N$) and $\epsilon$ ($Fe_{2,3}N$) intermetallics, and an inner "diffusion" zone which may be described as the original core microstructure with some solid solution and precipitation strengthening. Liquid nitriding involves immersing a steel part in a molten, nitrogen-containing fused salt bath containing cyanides or cyanates, e.g., NaCN or NaCNO. By increasing the hardness of the contact surface and reducing friction between it and the camming surface of the clamping pin, wear of the contact surface may be significantly lessened.

Also to reduce wear of the contact surface of the tang recess, the camming surface of the clamping pin desirably is rounded and smooth. The rounded nature of the camming surface 70 is evident in the embodiments of FIGS. 8, 10, 11, 13 and 14, but is less evident in FIGS. 9, 12 and 15. The surface 70 should be formed on a radius of not less than about 0.02 inches. When the pin is formed with an edge that appears visually abrupt or sharp, as in FIGS. 9, 12 and 15, the edge is radiused preferably in the range of about 0.02 to about 0.09 inches, and most preferably about 0.03 inches.

With reference to FIG. 7, as the clamping pin 68 moves to the left in a clamping operation, the vertical force component (R and R' in several of the Figures) lifts the tang of the tool until the force-transmitting surfaces 59, 61 of the tool and the tool holder come into contact. These force transmitting surfaces are generally horizontal, and serve to transmit the downward force of the tool holder to the tool in a workpiece bending operation. Referring now to FIG. 15, the recess 71 extends inwardly from the vertical surface 69 of the tang. It will be understood that the thickness of the tang at this point, and hence the strength of the tang body, may suffer as a recess is formed more deeply into the tang. That is, it is desired that the force transmitting surfaces 59, 61 come into seating engagement when the clamping pin has penetrated into the recess from the surface 69 no more than a relatively short distance, this distance being designated "d" in FIG. 15. The pin and recess desirably are so configured that the force-transmitting surfaces are brought into engagement when the pin has penetrated into the recess by a distance of no greater than about 0.09 inches, preferably by a distance in the range of about 0.04 to about 0.09 inches, and most preferably when the pin has penetrated into said recess by a distance of no greater than about 0.04 inches.

While a preferred embodiment of the present invention has been described, it should be understood that various changes, adaptations and modifications may be made therein without departing from the spirit of the invention and the scope of the appended claims.

The invention claimed is:

1. A press brake tool and a tool holder, the tool comprising a body terminating downwardly in a workpiece-engaging surface and a tang extending upwardly from the body and adapted for reception in the tool holder, the tang including a first wall defining a vertical surface and a second wall on the opposite side of the tang, the second wall having a recess formed therein, the recess including a contact surface; the tool holder comprising an opening therein for reception of the tool tang, a vertical surface engagable with said vertical surface of the tang, and a clamping pin movable transversely of the opening, the camming pin including a camming end configured to contact said contact surface of the tang, to exert a clamping force on said tang, the clamping force having vertical and horizontal components to raise said tang within the holder and clamp said vertical surfaces together, respectively; and wherein the tool and the tool holder include confronting, force transmitting surfaces that come into contact as said tang is raised within the tool holder opening, and said camming pin and said recess are configured to bring said force transmitting surfaces into contact when said pin has penetrated into said recess by a distance of no greater than about 0.09 inches.

2. The press brake tool and tool holder of claim 1 wherein said pin and said recess are configured to bring said force-transmitting surfaces into contact when said pin has penetrated into said recess by a distance ranging from about 0.04 to about 0.09 inches.

3. The press brake tool and tool holder of claim 1 wherein said pin and said recess are configured to bring said force-transmitting surfaces into contact when said pin has penetrated into said recess by a distance of no greater than about 0.04 inches.

4. The press brake tool and tool holder of claim 1 wherein said recess extends longitudinally, and said camming end of the pin contacts said contact surface of the tang in line contact, which line contact is substantially parallel to said longitudinal extent of the recess.

5. The press brake tool and tool holder of claim 1 wherein said camming end of the pin is formed on a radius not less than about 0.02 inches.

6. The press brake tool and tool holder of claim 5 wherein said camming end of the pin is formed on a radius in the range of about 0.02 to about 0.09 inches.

7. The press brake tool and tool holder of claim 5 wherein said camming end of the pin is formed on a radius of about 0.03 inches.

8. The press brake tool and tool holder of claim 1 wherein said contact surface of the recess, the camming end of the pin, or both, have a surface hardness in the range of about 60 to about 70 Rockwell C.

9. The press brake tool and tool holder of claim 8 wherein said camming end of the pin has a surface hardness that is less than that of the contact surface.

10. The press brake tool and tool holder of claim 9 wherein said camming end of the pin has a hardness in the range of about 45 to about 57 Rockwell C.

11. The press brake tool and tool holder of claim 1 wherein said camming end of the pin, the contact surface of the recess, or both, are flame hardened.

12. The press brake tool and tool holder of claim 1 wherein said camming end of the pin, the contact surface of the recess, or both, are nitrided or nitrocarburized.

13. The press brake tool and tool holder of claim 1 wherein said contact surface and said camming end of the pin are so configured that a ratio of the vertical clamping force component to the horizontal clamping force component changes as the clamping pin clamps against the contact surface of the tang.

14. The press brake tool and tool holder of claim 1 wherein said contact surface is generally convex to said camming end of the pin.

15. The press brake tool and tool holder of claim 1 wherein said contact surface is generally concave to said camming end of the pin.

16. The press brake tool and tool holder of claim 1 wherein said camming end of the pin is convex to said contact surface.

17. The press brake tool and tool holder of claim 1 wherein said camming end of the pin is concave to said contact surface.

18. The press brake tool and tool holder of claim 1 wherein said contact surface and said camming end of the pin are convex to each other.

19. The press brake tool and tool holder of claim 13 wherein said ratio of force components increases as the clamping pin clamps against the contact surface of the tang to provide an increasing lifting component.

20. The press brake tool and tool holder of claim 13 wherein said ratio of force components decreases as the clamping pin clamps against the contact surface of the tang to provide an increasing horizontal clamping component.

21. A press brake tool and a tool holder, the tool comprising a body terminating downwardly in a workpiece-engaging surface and a tang extending upwardly from the body and adapted for reception in the tool holder, the tang including a first wall defining a vertical surface and a second wall on the opposite side of the tang, the second wall having a recess formed therein, the recess including a contact surface with a surface hardness in the range of about 60 to about 70 Rockwell C; the tool holder comprising an opening therein for reception of the tool tang, a vertical surface engagable with said vertical surface of the tang, and a clamping pin movable transversely of the opening, the clamping pin including a camming end with a surface hardness in the range of about 45 to about 57 Rockwell C, the camming end being configured to contact said contact surface of the tang, said contact surface, said camming end or both being so configured as to engage each other in line contact and to exert a clamping force on said tang, the clamping force having vertical and horizontal components to raise said tang within the holder and clamp said vertical surfaces together, respectively.

22. A press brake tool and a tool holder, the tool comprising a body terminating downwardly in a workpiece-engaging surface and a tang extending upwardly from the body and adapted for reception in the tool holder, the tang including a first wall defining a vertical surface and a second wall on the opposite side of the tang, the second wall including a recess formed therein, the recess including a contact surface; the tool holder comprising an opening therein for reception of the tool tang, a vertical surface engagable with the vertical surface of the tang, and a clamping pin movable transversely of the opening, the clamping pin including a camming end configured to contact said contact surface of the tang, said contact surface and said camming end being so configured as to exert a clamping force on said tang, the clamping force having vertical and horizontal components, a ratio of the vertical component to the horizontal component changing as the clamping pin clamps against the contact surface of the tang.

23. The press brake tool and tool holder of claim 22 wherein said contact surface is generally convex to said camming end of the pin.

24. The press brake tool and tool holder of claim 22 wherein said contact surface is generally concave to said camming end of the pin.

25. The press brake tool and tool holder of claim 22 wherein said camming end of the pin is convex to said contact surface.

26. The press brake tool and tool holder of claim 22 wherein said camming end of the pin is concave to said contact surface.

27. The press brake tool and tool holder of claim 22 wherein said contact surface and said camming end of the pin are convex to each other.

28. The press brake tool and tool holder of claim 22 wherein said ratio of force components increases as the clamping pin clamps against the contact surface of the tang to provide an increasing lifting component.

29. The press brake tool and tool holder of claim 22 wherein said ratio of force components decreases as the clamping pin clamps against the contact surface of the tang to provide an increasing horizontal clamping component.

30. The press brake tool and tool holder of claim 22 wherein said recess of the tang includes a generally horizontal top wall intersecting said second wall, and wherein said camming end of the pin is concave toward said intersection.

31. The press brake tool and tool holder of claim 22 wherein said recess of the tang includes a generally horizontal top wall intersecting said second wall, and wherein said camming end of the pin is convex toward said intersection.

32. The press brake tool and tool holder of claim 22 wherein said recess extends longitudinally, and said camming end of the pin contacts said contact surface of the tang in line contact, which line contact is substantially parallel to said longitudinal extent of the recess.

33. The press brake tool and tool holder of claim 22 wherein said camming end of the pin is formed on a radius not less than about 0.02 inches.

34. The press brake tool and tool holder of claim 33 wherein said camming end of the pin is formed on a radius in the range of about 0.02 to about 0.09 inches.

35. The press brake tool and tool holder of claim 33 wherein said camming end of the pin is formed on a radius of about 0.03 inches.

36. The press brake tool and tool holder of claim 22 wherein said contact surface of the recess, the camming end of the pin, or both, have a surface hardness in the range of about 60 to about 70 Rockwell C.

37. The press brake tool and tool holder of claim 36 wherein said camming end of the pin has a surface hardness that is less than that of the contact surface.

38. The press brake tool and tool holder of claim 36 wherein said camming end of the pin has a hardness in the range of about 45 to about 57 Rockwell C.

39. The press brake tool and tool holder of claim 22 wherein said camming end of the pin, the contact surface of the recess, or both, are flame hardened.

40. The press brake tool and tool holder of claim 22 wherein said camming end of the pin, the contact surface of the recess, or both, are nitrided or nitrocarburized.

41. A press brake tool and a tool holder, the tool comprising a body terminating downwardly in a workpiece-engaging surface and a tang extending upwardly from the body and adapted for reception in the tool holder, the tang including a first wall defining a vertical surface and a second wall on the opposite side of the tang having an elongated recess formed therein, the recess including a contact surface with a surface hardness in the range of about 60 to about 70 Rockwell C; the tool holder comprising an opening therein for reception of the tool tang, a vertical surface engagable with said vertical surface of the tang, and a clamping pin movable transversely of the opening, the clamping pin including a camming end with a surface hardness in the range of about 45 to about 57 Rockwell C, the camming end being configured to contact said contact surface of the tang, said contact surface, said camming end or both being so configured as to engage each other and to exert a clamping force on said tang, the clamping force having vertical and horizontal components to raise said tang within the holder and clamp said vertical surfaces together, respectively.

* * * * *